US007926503B2

(12) United States Patent
Kuhnle et al.

(10) Patent No.: US 7,926,503 B2
(45) Date of Patent: Apr. 19, 2011

(54) FLUID INJECTION SYSTEM

(75) Inventors: Carl Kuhnle, Waco, TX (US); David Monteith, Thomasville, GA (US); Robert E. Wallace, Waco, TX (US)

(73) Assignee: The Wallace Group, Inc., Waco, TX (US)

( * ) Notice: Subject to any disclaimer, the term of this patent is extended or adjusted under 35 U.S.C. 154(b) by 913 days.

(21) Appl. No.: 11/748,355

(22) Filed: May 14, 2007

(65) Prior Publication Data

US 2007/0267070 A1 Nov. 22, 2007

Related U.S. Application Data

(60) Provisional application No. 60/747,208, filed on May 15, 2006.

(51) Int. Cl.
*B08B 3/08* (2006.01)

(52) U.S. Cl. ..... 137/15.06; 137/564.5; 137/240

(58) Field of Classification Search ..... 137/564.5, 137/197, 199, 99, 98, 114, 240, 15.04, 15.05, 137/15.06; 222/386.5, 389, 388, 61, 145.1, 222/55, 63, 334; 134/40
See application file for complete search history.

(56) References Cited

U.S. PATENT DOCUMENTS

| | | | | | |
|---|---|---|---|---|---|
| 3,194,500 | A * | 7/1965 | Byrd | 239/8 |
| 3,223,285 | A * | 12/1965 | Anderson | 222/651 |
| 3,610,535 | A * | 10/1971 | Bradshaw | 239/305 |
| 4,276,001 | A * | 6/1981 | Holmes | 417/401 |
| 4,311,160 | A * | 1/1982 | Charland | 137/111 |
| 4,330,003 | A * | 5/1982 | D'Alonzo | 137/100 |
| 5,170,912 | A * | 12/1992 | Du | 222/129.2 |
| 5,361,943 | A * | 11/1994 | Du | 222/134 |
| 5,433,240 | A * | 7/1995 | Mueller | 137/99 |
| 6,712,242 | B2 * | 3/2004 | Friedman | 222/129.2 |

* cited by examiner

*Primary Examiner* — Stephen M Hepperle
*Assistant Examiner* — Andrew J Rost
(74) *Attorney, Agent, or Firm* — Patterson & Sheridan, L.L.P.

(57) ABSTRACT

The present invention is directed toward an apparatus for efficient, durable, reliable, and cost-effective fluid injection. In particular, the present invention provides an unpowered device for automatic fluid injection dictated by pressure differential in the line. More specifically, the present invention provides a device for injecting a degreasing chemical into air relief valves in municipal wastewater systems, which operates off of the differential pressure in the pumped lines resulting from the pump operating cycles.

1 Claim, 1 Drawing Sheet

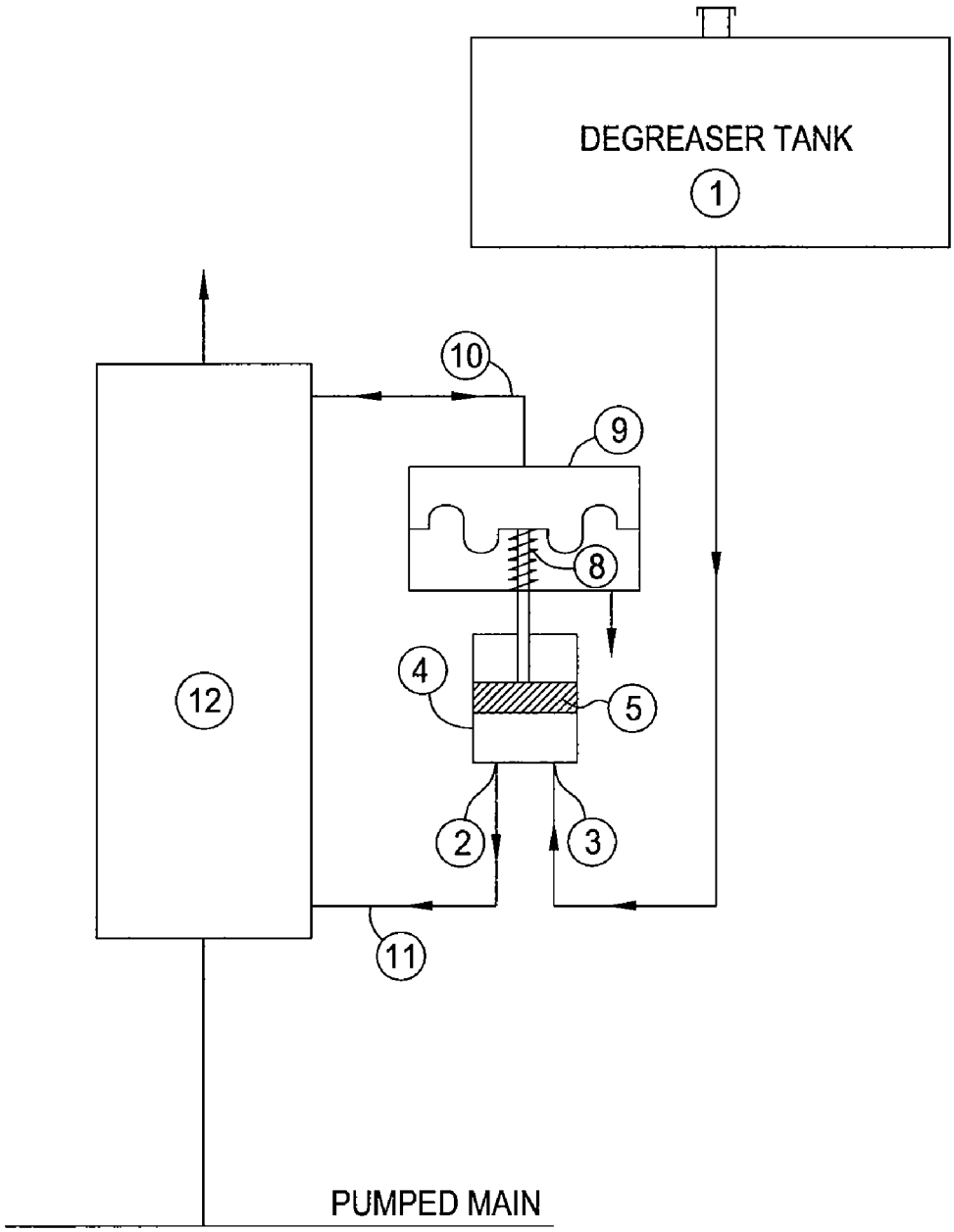
Figure

FLUID INJECTION SYSTEM

CROSS-REFERENCES TO RELATED APPLICATIONS

This application claims the benefit of U.S. Provisional Application No. 60/747,208 filed May 15, 2006.

BACKGROUND OF THE INVENTION

1. Field of the Invention

The present invention is directed toward an apparatus for efficient, durable, reliable, and cost-effective fluid injection. In particular, the present invention provides an unpowered device for automatic fluid injection dictated by pressure differential in the line. More specifically, the present invention provides a device for injecting a degreasing chemical into air relief valves in municipal wastewater systems.

2. Background Information

The ability to manipulate and control the flow of wastewater is a fundamental element in the infrastructure of any civilized society. Modem, municipal wastewater systems are typically designed to take advantage of the force of gravity to control the flow of the wastewater. This, of course, is accomplished by arranging the layout of the hydraulic infrastructure to flow in a downhill direction as much as possible. This system is extremely energy efficient and works well for the most part; however, in many instances, the terrain or other barriers require the direction of flow to be manipulated by a mechanical device. These pumping facilities, or lift stations, are thus required to pump the flow of the sewage over the high spots in the line of the sewage flow, in order to ensure the flow reaches the final treatment plant. Therefore, it is essential to the working structure of any wastewater system to not only have efficient and reliable lift stations, but it is also essential to have reliable pressure lines, or force mains, which carry the wastewater under pressure on its journey to the final treatment plant.

In order to properly protect these wastewater systems from air entrapment and surge (or water hammer), air relief valves must be installed at the "high" points in the sewage force mains. In essence, one requirement for air relief valves in the force main is to allow for release of air or gasses in the lines to prevent pressure build-up. Additionally, air or gasses must be released from the lines in order to reduce the surge, or water hammer, that results from the opening or closing of valves or pumping units throughout the system. However, not only must the air valves reliably open, in order to allow for release of air or gas pressure build-up in the lines, they must also reliably close, in order to prevent contamination of the surrounding areas, and water table in particular, due to the release of sewage through an air valve stuck in the open position.

Clearly, then, these air valves must reliably operate in all conceivable conditions, from urban settings to extremely remote areas, in order to both protect the force mains from over-pressure and water hammer, and to protect the environment from contamination from escaping wastewater. A number of conditions and environmental contributors can effect the reliable operation of such an air relief valve. One such condition is the collection of grease in the sewage lines at the high points of the force mains. Grease from the sewage collects at these points, and inhibits the operation of the air valves, particularly the opening of the air valves in order to prevent overpressure and surge in the sewage lines.

However, although the existence of degreasing chemicals are known in the art to deal with the buildup of grease, no reliable method of introducing the degreaser into the appropriate areas exists, to ensure reliable operation of the air valves. One reason for this lack of technology is the lack of widespread recognition in the art that grease is the culprit to the failure of these air relief valves. Another reason for the lack of development of a reliable, universal system that can be used anywhere in the sewage line for degreasing an air valve, is the fact that often times the remote locations of the air relief valves do not facilitate the use of an electronic or other powered means of actuation and control.

In view of the limitations of products currently known in the art, a tremendous need exists for an automatic fluid injection device that is efficient, durable, reliable, and cost-effective. Applicant's invention, by its novel design provides a solution in view of currently available devices.

SUMMARY OF THE INVENTION

In view of the foregoing, it is an object of the present invention to provide a device for fluid injection that reliable in operation.

It is another object of the present invention to provide a device for fluid injection that is efficient in operation.

It is another object of the present invention to provide a device for fluid injection that is durable.

It is another object of the present invention to provide a device for fluid injection that does not require a powered means for operation.

It is another object of the present invention to provide a device for fluid injection that is cost efficient.

In satisfaction of these and other related objectives, the present invention provides a device for the reliable injection of fluid. This system provides for an unpowered device for automatic fluid injection dictated by pressure differential in the line. As will be discussed in the specification to follow, the practice of the present invention provides a combination of components so aligned to provide a device for injecting a degreasing chemical into air relief valves in municipal wastewater systems in practically any environmental condition.

The preferred embodiment of the present invention incorporates a diaphragm device that utilizes the pressure generated by the initiation of a pressure cycle at the lift station of a municipal wastewater system in order to actuate a piston to force a degreaser chemical into the air relief valve at the high point of a force main. In other words, in a novel distinction from the known prior art, the present invention uses the pressure differential in the line in order to both control and power the injection of the degreaser chemical into the air valve to prevent a grease clog in the air valve of the system. Thus, no electricity or other power source is necessary to control the injection of the degreaser chemical other than the existing pressure differentials in the wastewater line itself.

The novelty and unobviousness of the present invention is exemplified by the concept of the device as provided by its operating sequence. The essence of the present invention is to apply the difference in line pressure that exists between the lift station pump on and off cycles to inject a specific amount of degreaser fluid into an automatic air vent. The typical operating sequence is as follows. During the pump off cycle, a diaphragm spring retracts a piston, drawing a specific amount of degreaser through a suction valve and into a cylinder. The spring is sized to overcome the minimum pressure that already exists in the pumped line. Then, during the pump on cycle, the force created by the diaphragm, which is tied into the vent line at the air valve, overcomes the discharge valve and advances the piston, discharging a specific amount of degreaser chemical through the discharge valve and into the automatic air vent. The pressure created by the piston is greater than the maximum pumped line pressure because the area of the piston is less than the area of the diaphragm.

In summary, then, an embodiment of the present invention provides a reliable, durable, cost-effective, device for automatically injecting a degreasing chemical into the air valve of a force main of a municipal wastewater system.

BRIEF DESCRIPTION OF THE DRAWINGS

Applicant's invention may be further understood from a description of the accompanying drawings, wherein unless otherwise specified, like referenced numerals are intended to depict like components in the various views.

The FIGURE is a schematic of an apparatus according to an embodiment of the present invention.

DETAILED DESCRIPTION OF THE PREFERRED EMBODIMENT

Referring to the FIGURE, a schematic for a device for controlling the reliable operation of an air venting system by injecting a degreasing chemical into the automatic air vent of a force main of a wastewater system is depicted. An example of a degreasing chemical that may be used in the present application is MICROSOLVE, manufactured and distributed by Arrow Cleaning and Hygiene Solutions in Derbyshire, DE; however, other comparable products, known in the industry, may be substituted within the scope of the present invention. The system itself operates off of an automatic air valve (12), which runs off of a vent line from the pumped line or force main. Actuation pressure line (10) is ported from the input side of automatic air valve (12). Examples of automatic air valves (12) that may be used in the system of the present invention include VENT-O-MAT Series RGX sewage air valves manufactured by Dynamic Fluid Control, Ltd. operating out of South Africa. Other comparable valves, known in the industry, may be substituted as well. Actuation pressure line (10) is in fluid connection with diaphragm (9), which controls the pressure needed to overcome the return spring (8) pressure, resulting in a specific amount of degreaser into air valve (12). The exact amount of degreaser needed to maintain proper functioning of air valve (12) is dependent on the specific degreasing chemical used, the specific air valve used, and the amount of grease encountered in the wastewater system, as may be predicted and/or determined by one skilled in the art. Return spring (8) in its normal position retracts piston (5) of cylinder (4) drawing a specific amount of degreaser fluid from degreaser tank (1) through suction valve (3). A degreaser tank (1) is required in order to store the proper amount of the degreaser (injecting fluid) necessary for an evaluated amount of time in order to ensure that the system will not run dry. For instance, a ten gallon tank may be required for a thirty day operating cycle; however, the exact quantity and capacity necessary will vary according to needs of the application and are accordingly within the scope of the present invention. When the pressure exerted on diaphragm (9) exceeds the return spring (8) pressure, piston (5) of cylinder (4) injects a specific amount of degreasing chemical into air valve (12) through pressure line (11).

In operation, the device uses the differential in line pressure that exists between the pump on and off cycles to inject a specific amount of degreaser fluid into an automatic air valve. The operating sequence to follow outlines the novel approach to this system, relying on the differential pressures in the wastewater system itself rather than complicated electronics or other power means. First, during the pump off cycle, return spring (8) retracts piston (5), drawing degreaser from degreasing tank (1) through suction valve (3) and into cylinder (4). In the preferred embodiment of the present invention, return spring (8) must be sized to overcome the minimum pressure that normally exists in the pumped line, which is readily calculable by one skilled in the art. Next, during the pump on cycle, the force created by diaphragm (9) from the actuating pressure line (10) overcomes the return spring (8) pressure and advances piston (5) discharging a specific amount of degreaser chemical through discharge valve (2) into pressure line (11) and into automatic air valve (12). In the preferred embodiment, the pressure created by piston (5) must be greater than the maximum pumped line pressure; therefore, the area of piston (5) must be less than the area of diaphragm (9).

Although the invention has been described with reference to specific embodiments, this description is not meant to be construed in a limited sense. Various modifications of the disclosed embodiments, as well as alternative embodiments of the inventions will become apparent to persons skilled in the art upon reference to the description of the invention. It is, therefore, contemplated that the appended claims will cover such modifications that fall within the scope of the invention.

We claim:

1. A process for controlling grease buildup in wastewater air venting systems, comprising:

monitoring pressure at an input side of an air relief valve in a wastewater system;

drawing a specified amount of degreaser chemical into a cylinder when said pressure at said input side of the air relief valve drops below a specified level; and injecting said specified amount of degreaser chemical at the input side of said air relief valve via said cylinder when said pressure at the input side of said air relief valve exceeds said specified level.

* * * * *

UNITED STATES PATENT AND TRADEMARK OFFICE

CERTIFICATE OF CORRECTION

PATENT NO. : 7,926,503 B2
APPLICATION NO. : 11/748355
DATED : April 19, 2011
INVENTOR(S) : Kuhnle et al.

It is certified that error appears in the above-identified patent and that said Letters Patent is hereby corrected as shown below:

Column 1, Line 22, please delete “modem” and insert --modern-- therefor.

Signed and Sealed this
Twelfth Day of July, 2011

David J. Kappos

David J. Kappos
*Director of the United States Patent and Trademark Office*